US006289326B1

(12) United States Patent
LaFleur

(10) Patent No.: US 6,289,326 B1
(45) Date of Patent: Sep. 11, 2001

(54) PORTABLE INTERACTIVE KIOSK

(76) Inventor: Bernard B. LaFleur, 539 Randolph Ave., Pulaski, VA (US) 24301

( * ) Notice: Subject to any disclaimer, the term of this patent is extended or adjusted under 35 U.S.C. 154(b) by 0 days.

(21) Appl. No.: 08/868,659

(22) Filed: Jun. 4, 1997

(51) Int. Cl.[7] ..... A47B 81/06
(52) U.S. Cl. ..... 705/702; 312/258; 348/838
(58) Field of Search ..... 312/7.2, 258, 114; 348/836, 838, 794

(56) References Cited

U.S. PATENT DOCUMENTS

| | | | | |
|---|---|---|---|---|
| 1,199,293 | * | 9/1916 | Montgomery | 312/258 X |
| 1,986,077 | * | 1/1935 | Spang | 312/258 X |
| 2,803,305 | * | 10/1957 | Jackson | 312/258 X |
| 4,378,828 | * | 4/1983 | Shiminski | 312/258 X |
| 4,510,378 | * | 4/1985 | Dolson | 312/258 X |
| 5,072,999 | * | 12/1991 | Trotta et al. | 312/258 X |
| 5,224,768 | * | 7/1993 | Vautier | 312/262 |
| 5,259,669 | * | 11/1993 | Leach et al. | 312/258 |
| 5,456,468 | * | 10/1995 | Stringfellow et al. | 312/223.3 X |
| 5,664,854 | * | 9/1997 | Letch | 312/262 |
| 5,758,935 | * | 6/1998 | Coonan | 312/223.3 |
| 5,938,302 | * | 8/1999 | Anderson et al. | 312/223.1 |

* cited by examiner

*Primary Examiner*—Peter M. Cuomo
*Assistant Examiner*—Jerry A. Anderson
(74) *Attorney, Agent, or Firm*—Robert E. Bushnell, Esq.

(57) ABSTRACT

A portable kiosk configured to function as an architectural component of a exhibition and present a variable visual display to customer traffic while accommodating hands-on interaction with the customers during the exhibition and serve as a housing for the electronic components of the display during transport between successive exhibitions. The kiosk is constructed with an upright main body mounted upon casters, and a plurality of pivotally mounted internal, shock absorbing shelves configured to securely mount sensitive electronic and audio-visual equipment. A pair of oppositely mounted side frames are supported by the main body, and may be rotatably deployed during set-up to support the shelves and a mount for a variable visual display and a tray for other peripheral equipment such as a keyboard and mouse. During knock-down, the shelves are rotatable into the interior of the main frame while bearing their respective items of electronic and audio-visual equipment while the mount is rotatably dropped across the front of the main frame. Other members are removable without tools and stored in the interior of the main frame, while the side frames are then folded across the front of the main frame, and the entire assembly is wheeled into a shipping container substantially smaller in volume than the erected kiosk and acceptable by competing international courier carriers for overnight delivery at the site of the next trade show.

26 Claims, 18 Drawing Sheets

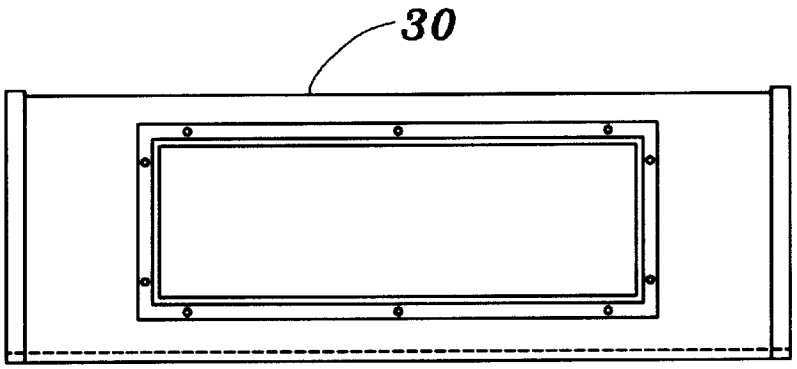
Fig. 27
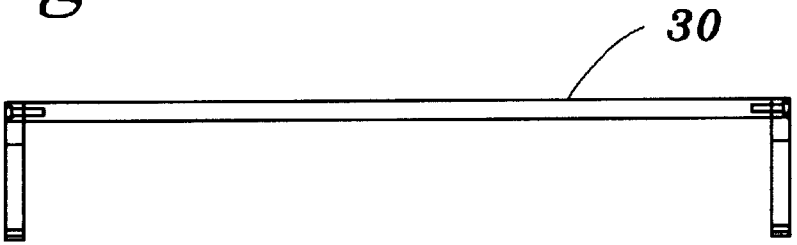
Fig. 29
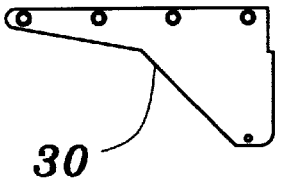
Fig. 28
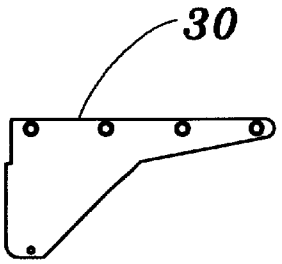

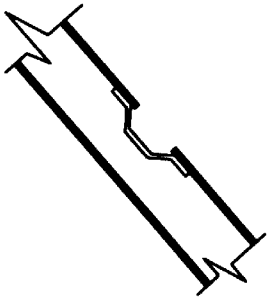
Fig. 33
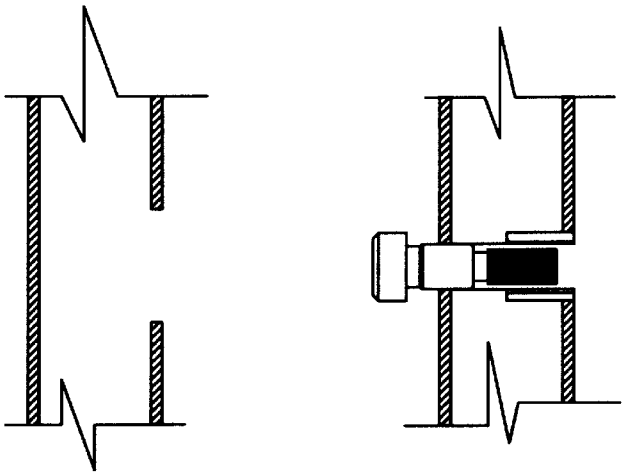
Fig. 34
Fig. 35
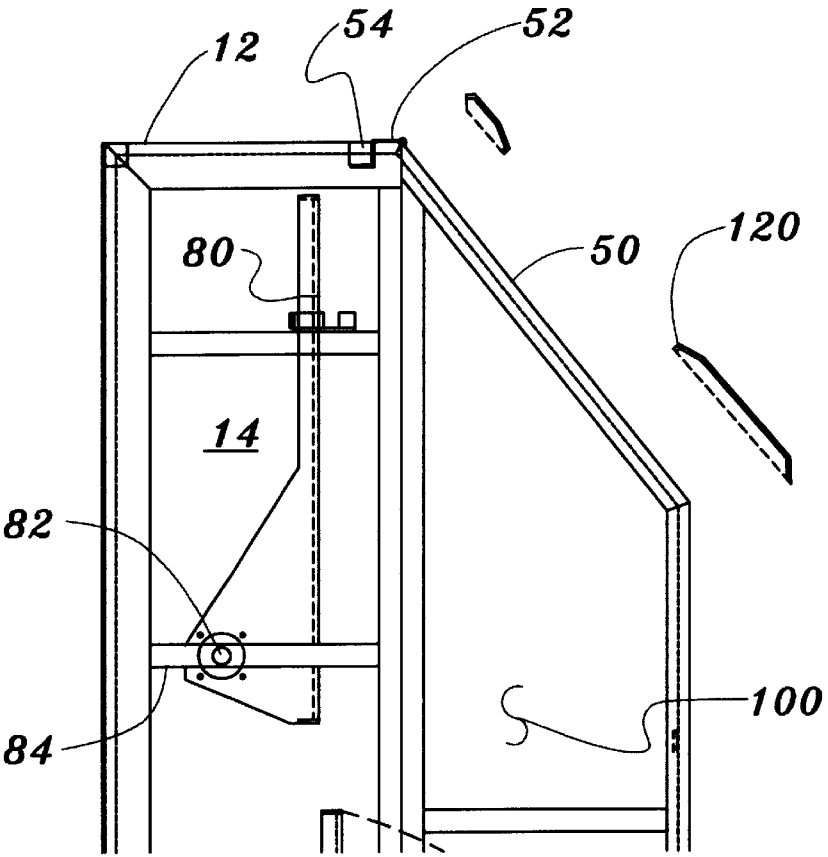
Fig. 32

PORTABLE INTERACTIVE KIOSK

BACKGROUND OF THE INVENTION

1. Field of the Invention

This invention relates to display processes and devices generally, and more particularly, to portable kiosks generating a variable visible display while accepting and responding to inquiries from viewers.

2. Background Art

The convention and trade-show industry has grown substantially over the past three decades, with municipalities each constructing large exhibition halls and competing to host several conventions and shows every year. Generally, contemporary designs for convention and trade-show booths seek to present visual displays endowed with sufficient aesthetic quality to appear as exhibits able to attract substantial customer traffic during the course of the show. The architectural components of the booths and their visual displays require substantial time for unpacking, erection and electrical wiring prior to the scheduled opening of the show, with a similar requirement of time and labor for a knock-down of the visual display by disassembly, packing and crating at the end of the show, in preparation for an expedited shipment to the site of the next show. Concomitantly, contractual requirements with municipally owned and urban located exhibition halls and centers invariably require the use of various trade crafts, including locally hired carpenters, electricians, riggers and laborers, often at union wage scale, frequently with overtime and week-end wage differentials, to complete the erection of the display. With the knock-down at the end of each show, the shock sensitive electrical equipment, including audio-visual units, computers, monitors and keyboards, must be removed from the architectural components of the display and separately packed in specialized shipping containers.

Not infrequently, exhibitions and trade shows are scheduled on a circuit, with the closing of an exhibition in one city followed in one or two days, by the opening of a trade show in a different city that is not infrequently, located in a different area of the country. Traditionally, transportation of trade show exhibits is arranged either by contract or specialized haulers, typically using trailer trucks, a source of additional cost as well as delay in re-erection of the exhibit at the next trade show.

SUMMARY OF THE INVENTION

It is therefore, one object to the present invention to provide an improved interactive kiosk.

It is another object to provide a process and portable structure capable of generating a variable visual display during interaction with pedestrian traffic within the vicinity of the structure.

It is still another object to provide a portable kiosk able to serve as a shipping container for delicate electronic equipment.

It is yet another object to provide a transportable kiosk suitable to house electronic equipment during exhibitions in a manner enabling persons attending the exhibitions to interact with the kiosk, while protecting that electronic equipment from damage during transport between exhibitions.

It is still yet another object to provide a portable kiosk amenable to on-site erection, and subsequent knock-down, by a single individual, with a minimum of effort.

It is further object to provide a self-contained portable kiosk demonstrating a substantially greater volume when in its erected state, than while in its folded state.

It is a still further object to provide a portable kiosk that, when collapsed, will be accepted as ordinary overnight freight by international cargo carriers and couriers, for overnight and next-day delivery.

It is a yet further object to provide a portable and foldable electronically interactive kiosk that when in its knocked-down, collapsed state, is able to contain all component parts used by the kiosk during its erected, unfolded state.

It is still a yet further object to provide a portable electronically interactive kiosk able to securely mount a wide range of different sizes of electronic equipment using corner brackets with each of the brackets able to provide three-fasterner attachment to a rotatable shelf for over ninety percent of the different sizes.

It is also an object to provide a portable, electronically interactive kiosk sheathed with exterior, double-sided panels.

These and other objects may be achieved with an electronically interactive kiosk having an upright main body mounted upon casters, and a plurality of pivotally mounted internal, shock absorbing shelves configured to securely mount sensitive electronic and audio-visual equipment. A pair of oppositely mounted side frames are supported by the main body, and may be rotatably deployed during set-up to support the shelves and a mount for a variable visual display and a tray for other peripheral equipment such as a keyboard and mouse. During knock-down, the shelves are rotatable into the interior of the main frame while bearing their respective items of electronic and audio-visual equipment when the mount is rotatably dropped across the front of the main frame. Other members are removable without tools and stored in the interior of the main frame, while the side frames are then folded across the front of the main frame, and the entire assembly is wheeled into a shipping container substantially smaller in volume than the erected kiosk and acceptable by competing international courier carriers for overnight delivery at the site of the next trade show.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein:

FIG. 27 is an under-side view of a keyboard shelf;

FIG. 28 is an end view of a keyboard shelf;

FIG. 29 is a front view of a keyboard shelf;

FIG. 32 is a partial side view showing orientations of a top shelf and the bezel cover;

FIG. 33 is a detailed view of the bezel cover;

FIG. 34 is a detailed view of a structural fastener;

FIG. 35 is a detailed view of a structural fastener;

DETAILED DESCRIPTION OF THE INVENTION

Figure 1:
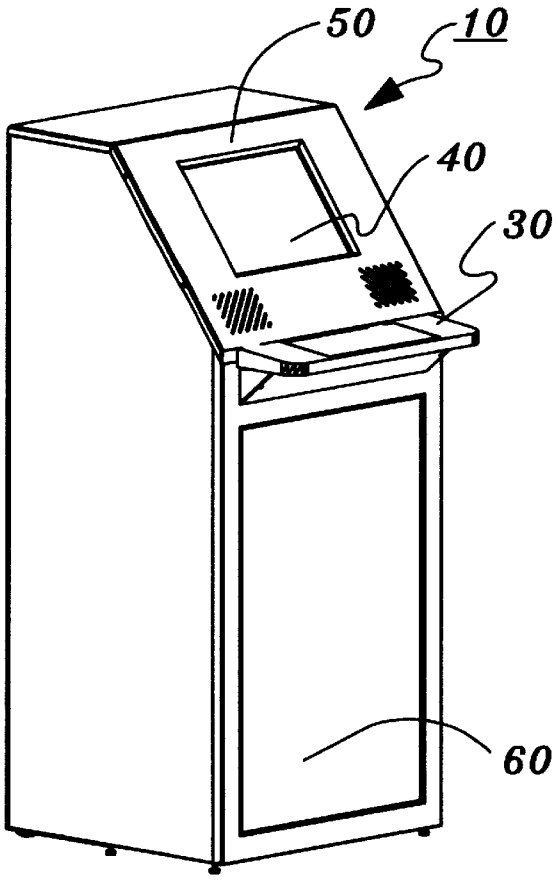
FIG. 1 is a perspective view showing one embodiment constructed according to the principles of the present invention, in an installed configuration.

Turning now to the drawings, FIG. 1 illustrates an upright kiosk 10 in its deployed state, with a keyboard shelf 30 supported by a front panel 60, to extend substantially horizontally outwardly and support a keyboard, mouse and other peripheral equipment that may be mounted upon shelf 30. An obliquely oriented screen mount 50 positions a visual screen 40 such as a thin film touch screen, able to provide customer traffic with a varying visual display.

Figure 3:
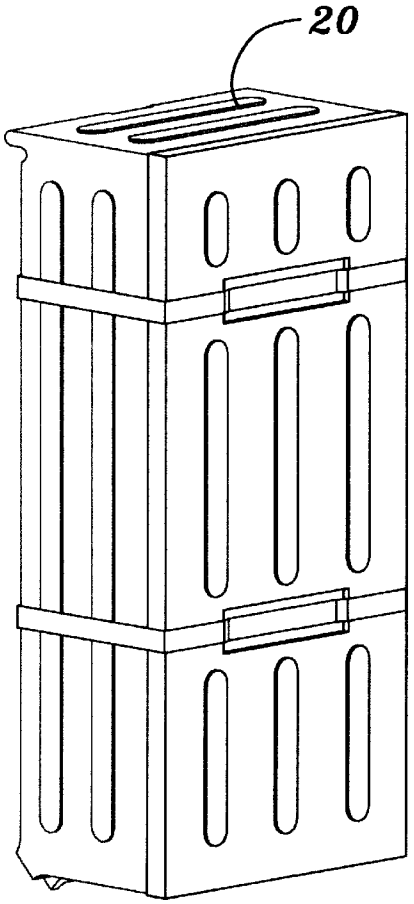
FIG. 3 is a perspective view of a shipping container suitable for transporting the embodiment of FIG. 1, while in the folded configuration shown in FIG. 2.
Figure 2:
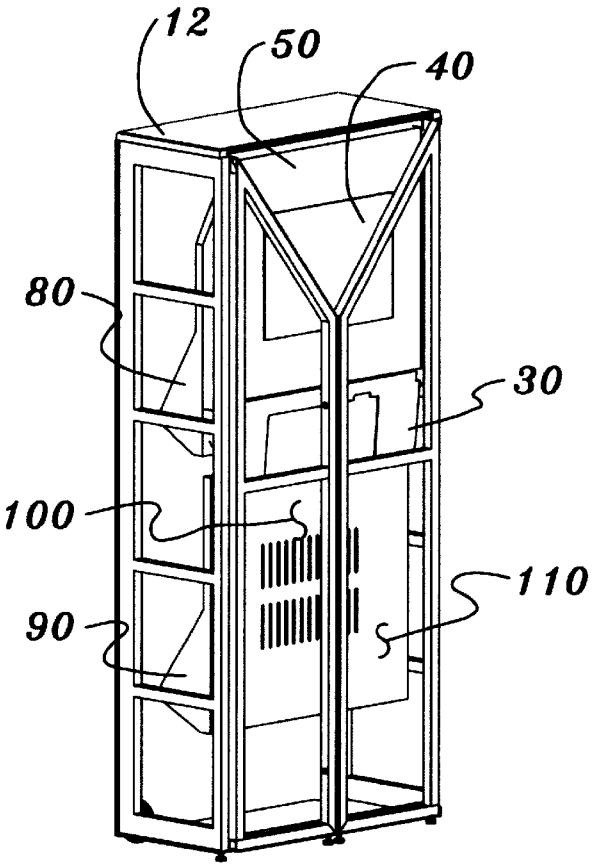
FIG. 2 is a perspective view showing the embodiment of FIG. 1, in a folded configuration.

FIG. 2 shows kiosk 10 in a folded, or knocked-down state, with upper and lower shelves 80, 90 (not visible in FIG. 1), together with the electronic and audio-visual equipment (e.g., a computer and an image projector) securely mounted upon these shelves, rotated vertically upwardly into the interior of main frame 12. Visual screen 40 and its mount after removal and storage of the side panels sheathing within the interior of main frame 12, and after having been rotated downwardly across the front of main frame 12 to place keyboard shelf 30 in substantial vertical alignment with mount 50 across the front of main frame 12. Left and right side frames 100, 110 are rotated to lie vertically across the front of main frame 12 and screen mount 50. When folded in the manner shown, the entire kiosk 10, together with all of the electronic equipment (e.g., a microprocessor based computer equipped with a hard disk, and a visual image projector) mounted upon shelves 80, 90, as well as visual screen 40 (which may be a touch sensitive screen in particular applications) together with a computer keyboard mounted within shelf 30, may be placed with the interior of a standard, rigid body shipping container 20. This size of package is then immediately acceptable by both FedEx Corporation and UPS Corporation, for overnight delivery anywhere within the contiguous United States, and alternatively, readily acceptable for shipment by commercial airlines as excess baggage.

Figure 6:
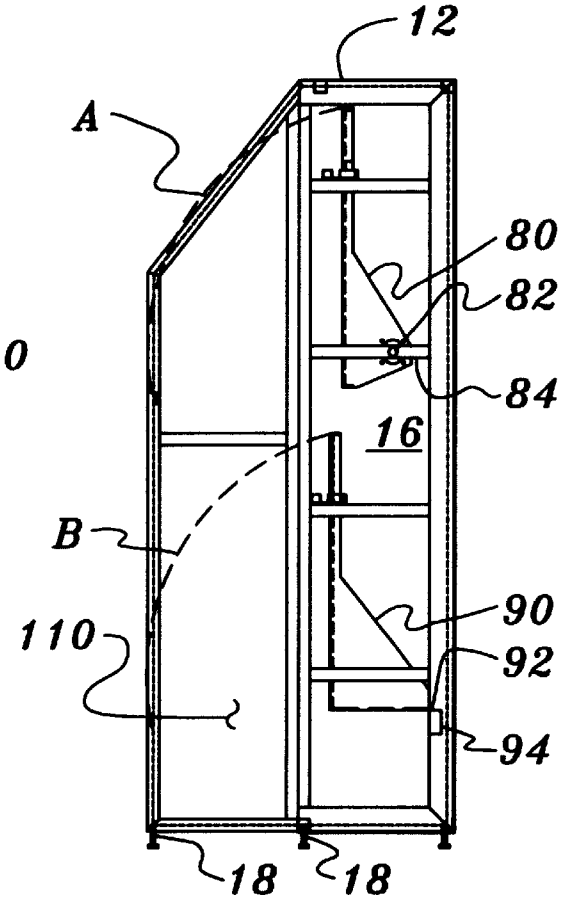
FIG. 6 is a right elevational view showing the location of a plurality of shelves within the assembled super structure.
Figure 5:
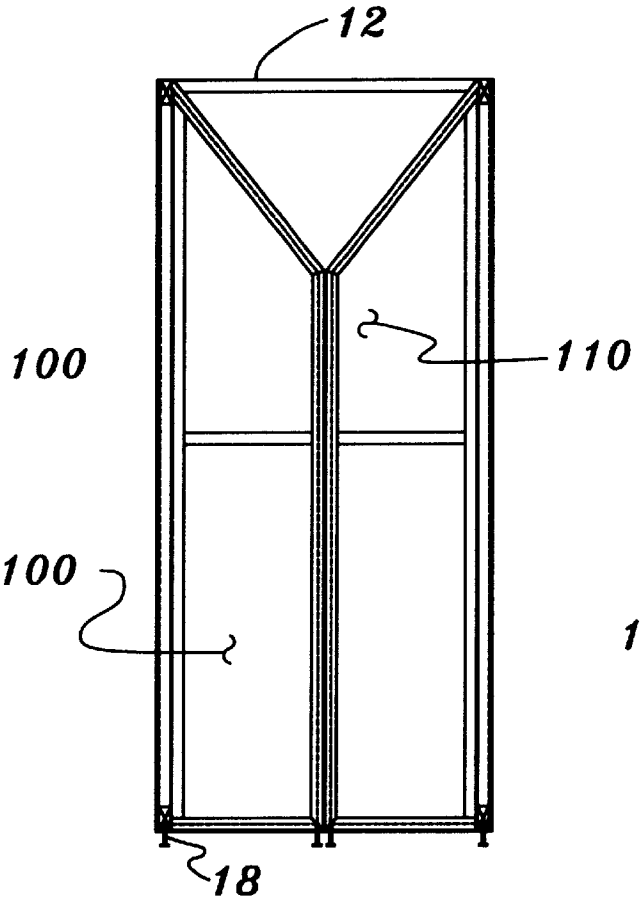
FIG. 5 is a front elevational view of the structural frame of the super structure.
Figure 4:
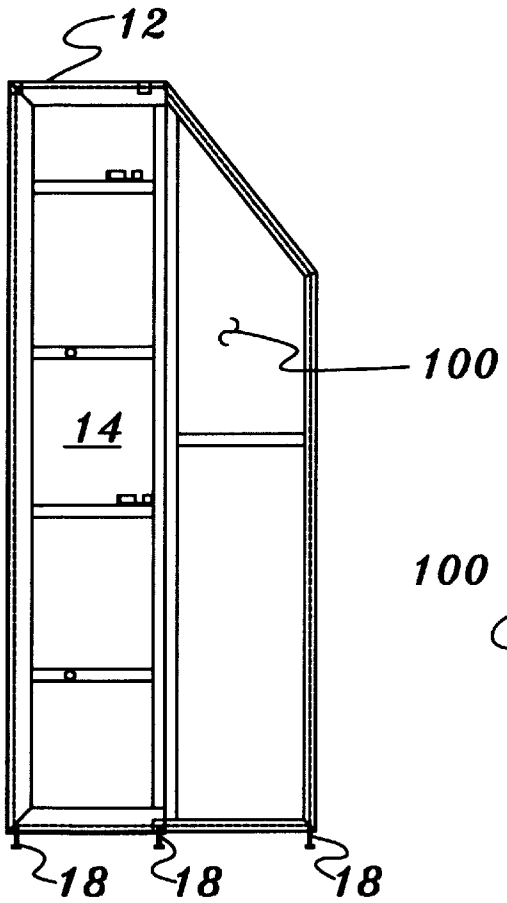
FIG. 4 is a left elevational view of the structural frame for the super structure.
Figure 44:
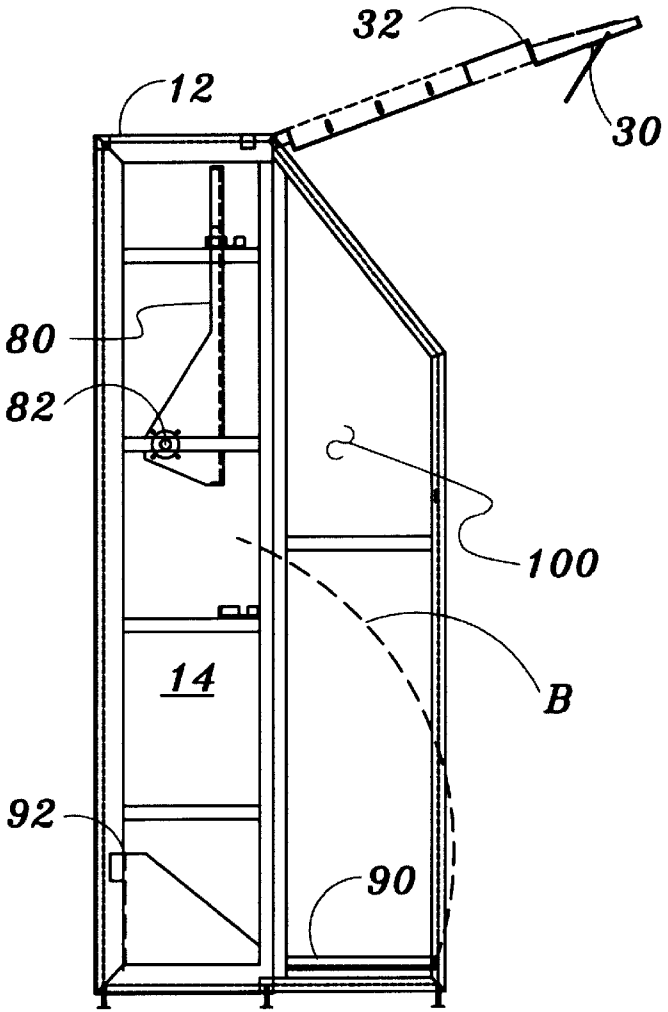
FIG. 44 is a side elevational view showing a third set of operational positions.

FIG. 4 shows left side frame 100 pivotally mounted upon the left side of main frame 12, while 9 in a deployed position planarly aligned with the left side 14 of main frame 12. FIG. 5 shows the left and right side frames folded across the front of main frame 12, either prior to deployment during set up, or after knock-down and before insertion into shipping container 20. FIG. 6 shows upper and lower shelves 80, 90 pivoted into their respective vertical knock-down positions within main frame 12. Arcs A, B of shelves 80, 90 are shown relative to side frame 110 while side frame 110 is in its unfolded position after being rotatably deployed outwardly from main frame 12. Upper equipment shelf 80 is pivotally connected to a side cross member 84 of main frame 12 with a pinion 82; as shown in greater detail by FIG. 43, the distal end of shelve 80 follows arc A during deployment. Lower equipment shelf 90 is rotatably connected to a rear cross member 94 of main frame 12 as by a continuous, or panio hinge 92 in order to evenly distribute its load across the width of cross member 94. Referring briefly to FIG. 44 in conjunction with FIG. 6, the distal end of lower shelf 90 traces arc B during deployment from its vertical to its horizontal position during set-up. Leveling feet 18 mounted in the lowermost structural members of main frame 12 and side frames 14, 16, may be adjusted to obtain perpendicular vertical alignment between the upright kiosk 10 and the floor.

Figure 7:
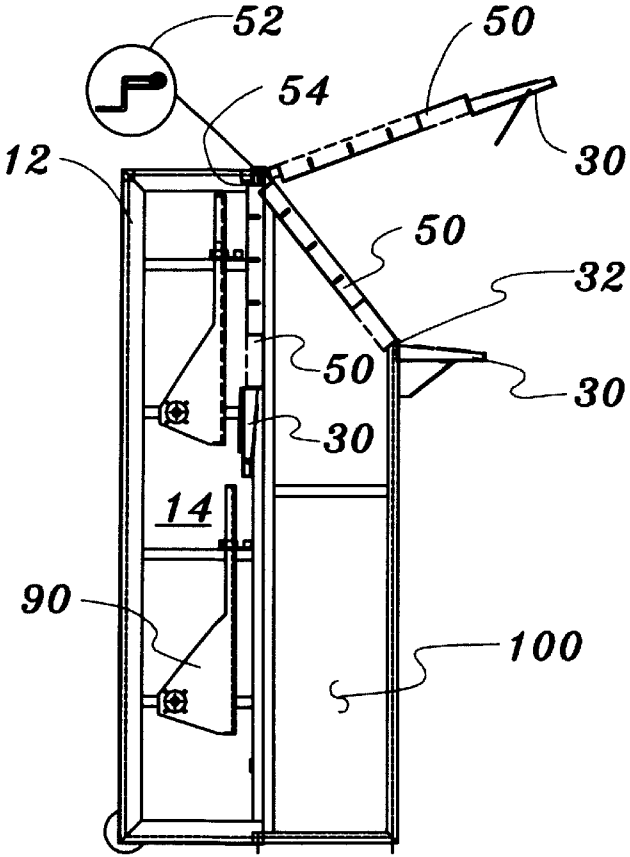
FIG. 7 is a side elevational view showing the structural orientation of visual display screen.
Figure 42:
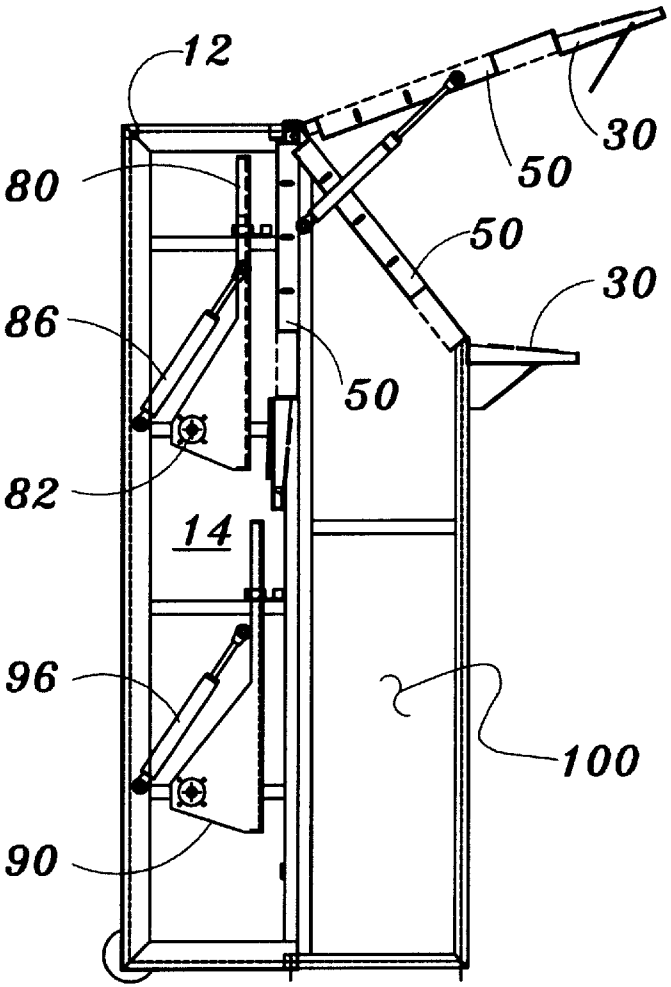
FIG. 42 is a side elevational view showing one set of operational positions during set-up.
Figure 43:
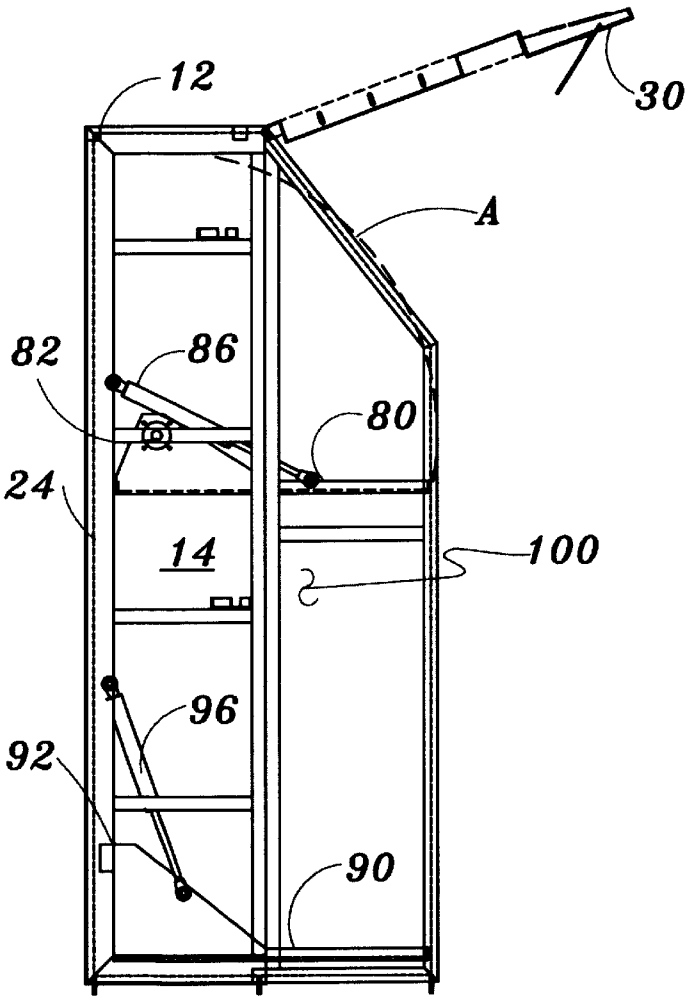
FIG. 43 is a side elevational view showing a second set of operational positions.

FIG. 7 shows keyboard shelf 30 in each of three positions: its vertical position while stored within main frame 12, its raised position while substantially planarly aligned with the surface of mount 50 while both mount 50 and shelf 30 are raised to accommodate deployment of upper shelf 80, as is shown in greater detail in FIG. 43, and in its normally deployed position while horizontally braced and thereby supported by the front vertical member of side frame 100. In the last position, shelf 30 is able to position a keyboard for comfortable use by passing visitors to the kiosk. Shelf 30 is rotatably attached to the lowermost horizontal distal edge of mount 50 as with a continuous hinge 32. The uppermost horizontal surface of mount 50 is rotatably attached with an offset continuous hinge 52 to a horizontal cross member 54, as is shown in greater detail in FIG. 32. In FIG. 7, both upper and lower shelves 80, 90 are shown in their stored, vertical positions within the interior of main frame 12. Referring again to FIGS. 42 and 43, a gas cylinder shock absorber 86 connects upper shelf 80 to the rear vertical upright member 24 to cushion movement during storage, as well as its downward rotation deployment; a gas cylinder shock absorber 96 connects lower shelf 90 to member 24. Shock absorbers 86, 96 slow, and thereby ease the descent of shelves 80, 90 from their stowed vertical (n. b., while in their respective stowed positions, shelves 80, 90 are vertical when kiosk 10 is in an upright position) positions to their horizontal deployed positions.

Figure 8:
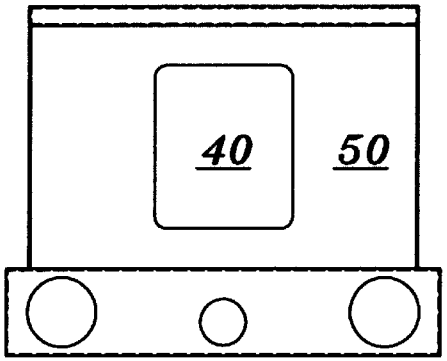
FIG. 8 is a front view showing structural details of the mount for the display screen.
Figure 9:
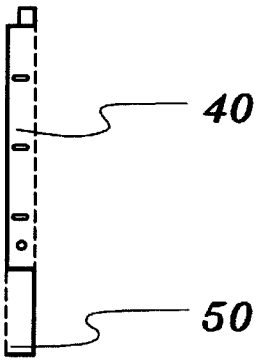
FIG. 9 is a profile view of the mount showing in FIG. 8.

FIGS. 8 and 9 show mount 50 holding a thin film touch capacitive touch screen 40. As presented to the passing visitor traffic, mount 50 orients screen 40 upwardly, at an angle easily seen by an adult human being. Digital manipulation of either touch screen 40, or a keyboard mounted upon shelf 30, enables a visitor to readily electronically interact with, for example, a personal computer and its stored audio-visual program, mounted upon either upper or lower shelves 80, 90.

Figure 12:
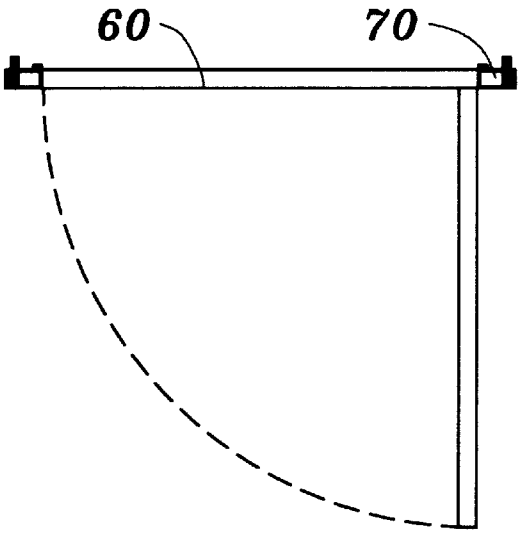
FIG. 12 is a top view of the front panel.
Figure 11:
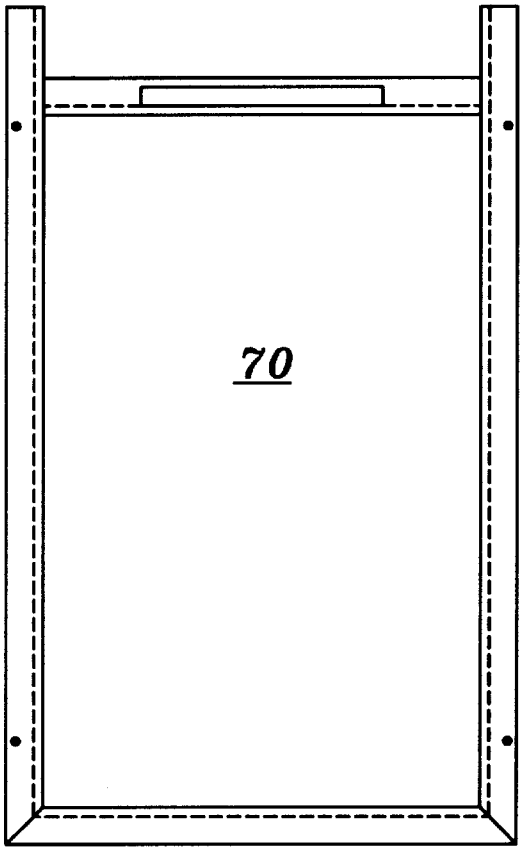
FIG. 11 is a front elevational view of the front panel.
Figure 10:
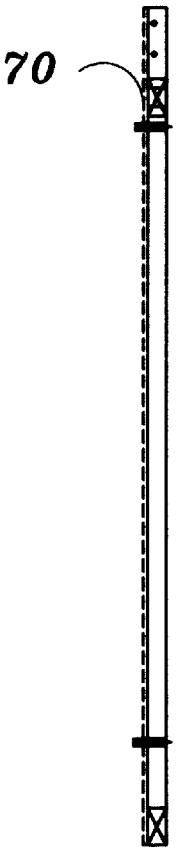
FIG. 10 is a profile view of a front panel.
Figure 14:
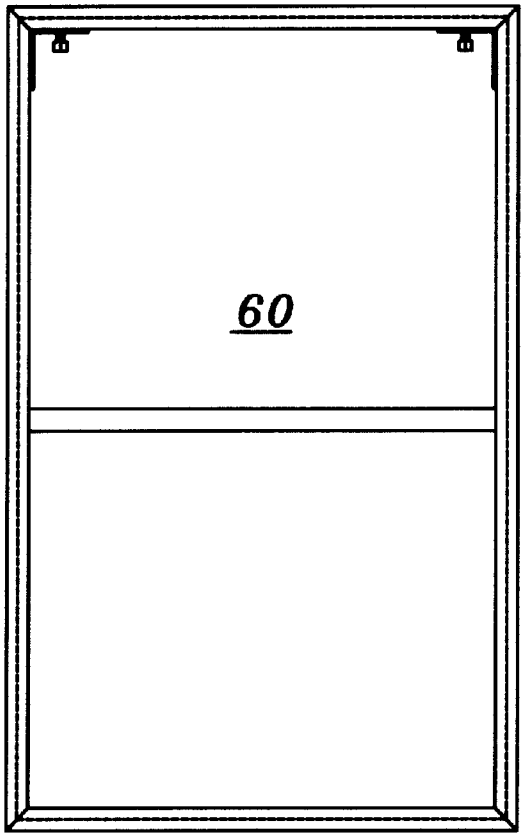
FIG. 14 is a front elevational view of an access door.
Figure 13:
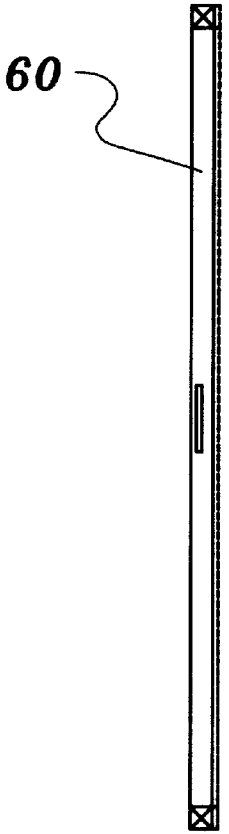
FIG. 13 is a side elevational view of an access door.

FIGS. 10 and 11 show details of a front frame 70 joining left and right side frames 100, 110 of main frame 12, while accommodating rotational deployment of the distal ends of the upper and lower shelves 80, 90. FIGS. 12, 13 and 14 illustrate the details of an access door 60 in the front frame 70 of main frame 12 that accommodates storage of bezel 120 covering the periphery of touch screen 40 during shipment after knock-down of the kiosk.

Figure 15C:
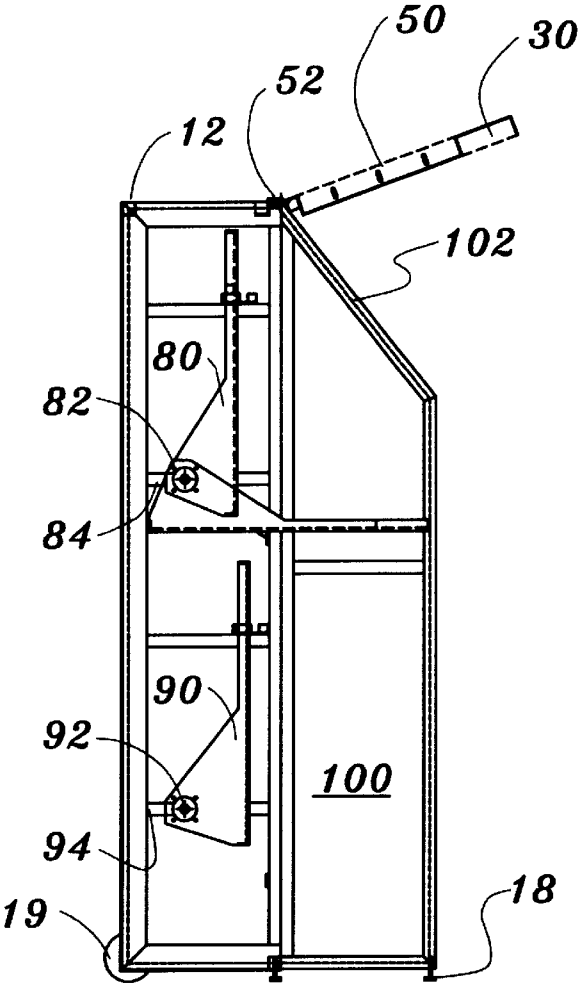
FIG. 15C is a left elevational view of the embodiment of FIG. 15B, showing deployment of front panels, an upper shelf and a display panel.
Figure 15B:
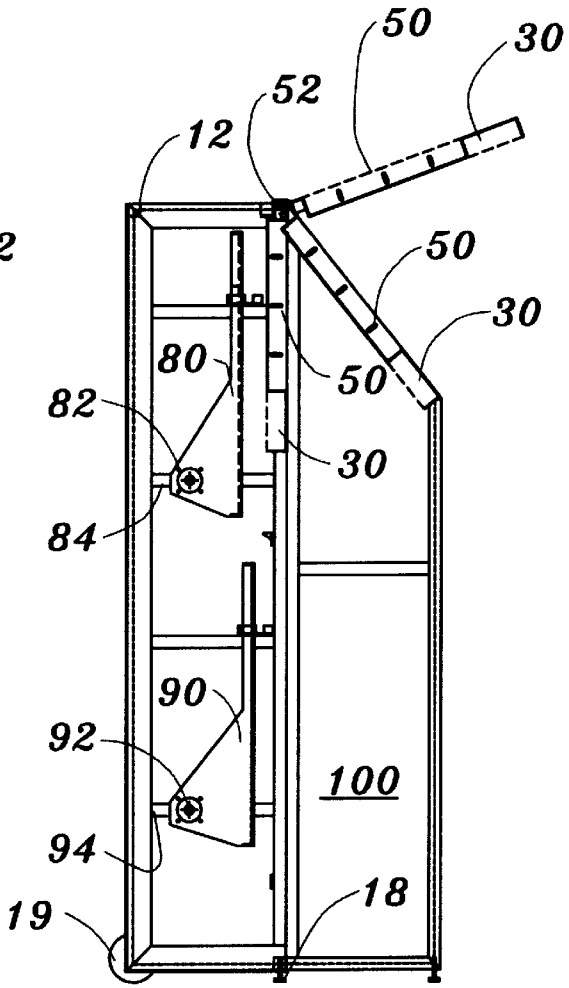
FIG. 15B is a left elevational view of an alternative embodiment showing partial deployment of front panels and a display panel.
Figure 15A:
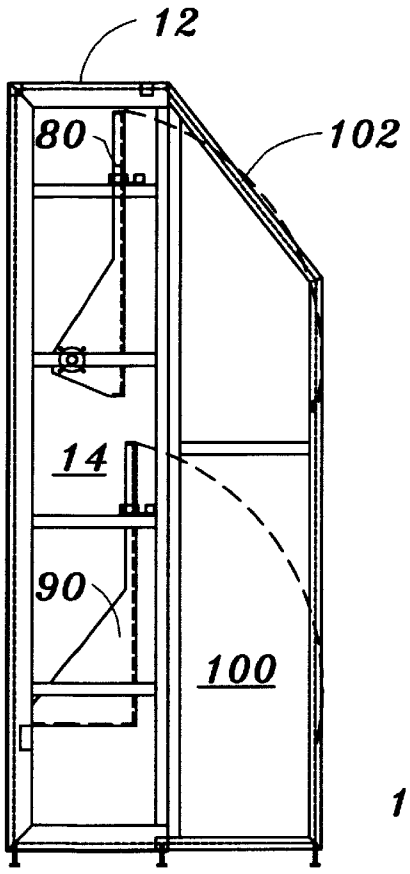
FIG. 15A is a left elevational view showing structural details of the superstructure of one embodiment.

FIG. 15A shows a left side elevational view with left side frame 100 in its open position forming a single planar surface with left side 14, while both upper and lower shelves 80, 90 remain in their vertical stowed positions.

Figure 20:
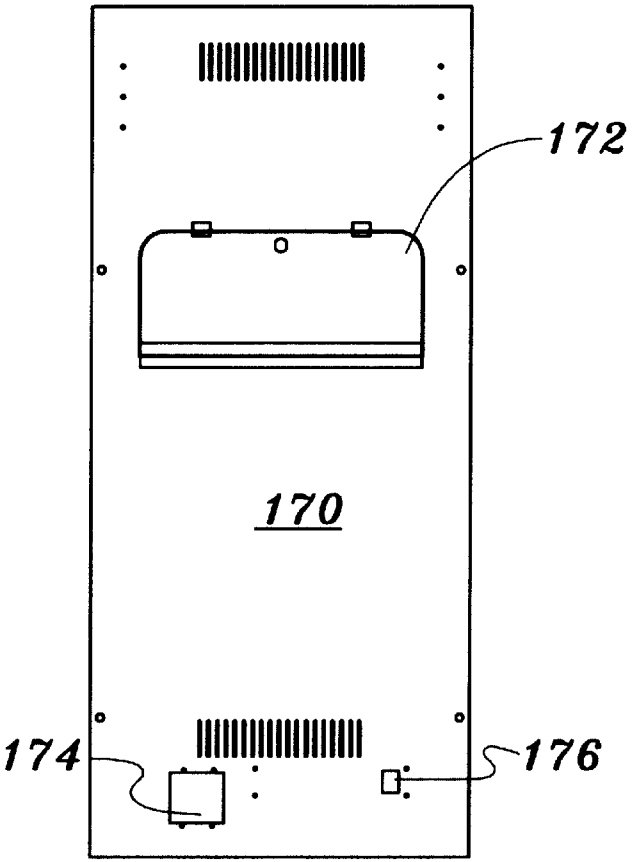
FIG. 20 is an elevational view of the back panel.

FIG. 15B shows a left side elevational view of an alternative embodiment constructed with a pair of recessed casters 19 at the lower, rear corners of the junctions between the left and right side frames 14, 16 and the rear panel 130 (shown in greater detail in FIG. 20). This embodiment is fitted with upper and lower shelves 80, 90 of similar configuration, having substantially equal lengths and widths, rotatably mounted upon shock absorbing pivots 82', 92' attached to structural members 84, 94 respectively, of side frames 14, 16, to pivot between stowed and deployed positions. Shelves 80, 90 are shown as pivoted vertically upwardly while left side frame 100 is in an open position to form a single planar surface with left side 14. Screen mount 50 is shown as rotated from its vertical stored position at one extreme to an upward, temporally intermediate position at a second extreme, and then to a spatial intermediate deployed position where the opposite side edges of screen mount 50 are supported by the oblique transverse members 102 forming the upper extremities of left and right side frames 100, 110.

Figure 15D:
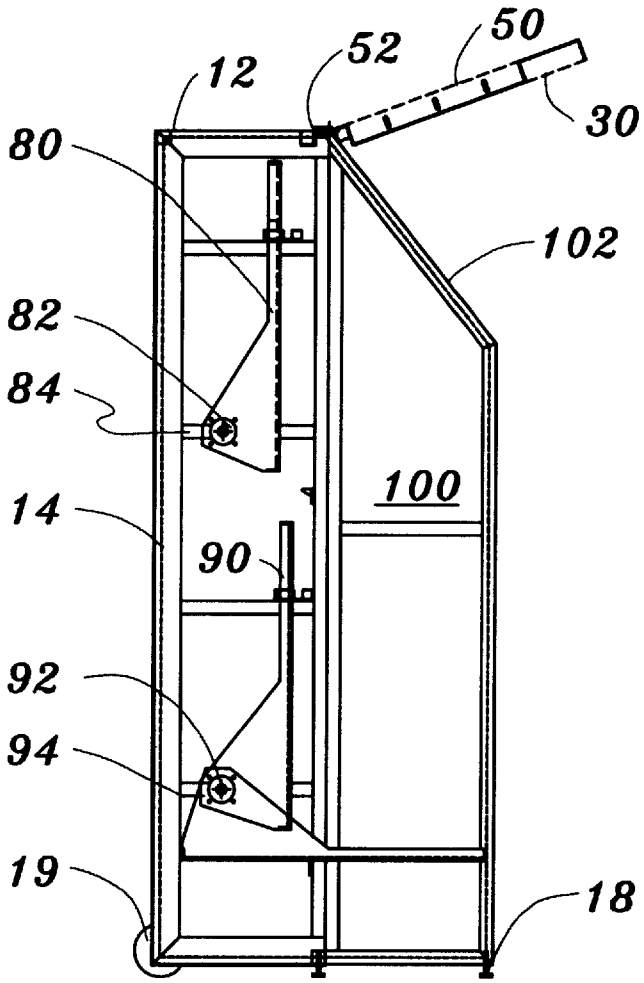
FIG. 15D is a left elevational view of the embodiment of FIG. 15B, showing deployment of front panels, a lower shelf and a display panel.
Figure 18:
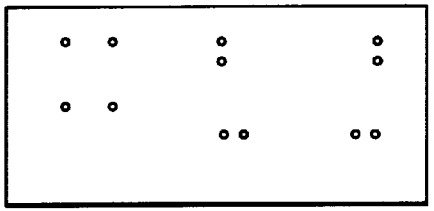
FIG. 18 is a side view of the base plates.
Figure 17:
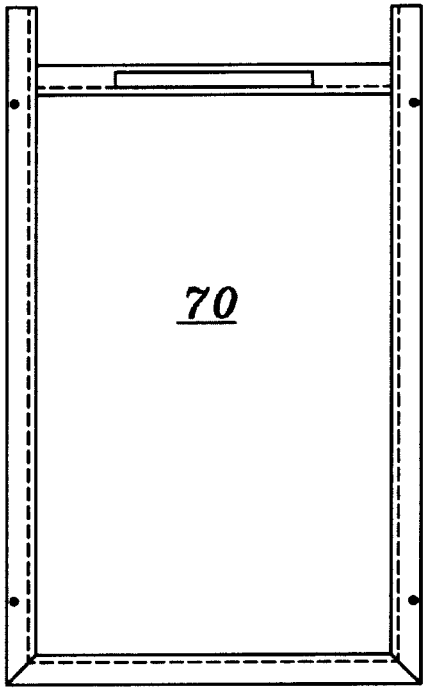
FIG. 17 is a rear elevational view of the front panel.
Figure 16:
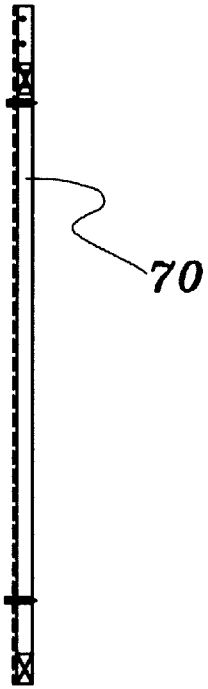
FIG. 16 is a side elevational view showing structural details of the superstructure.

As shown in FIG. 15C, upper shelf 80 is shown in both of its operational extremes, vertically in its stowed (or knocked-down) position used during shipment of the kiosk, and horizontally in its deployed position, while FIG. 15D shows lower shelf 90 in both of its operational extremes, vertically in its stowed position, and horizontally in its deployed position. Shelves 80, 90 remain in their respective deployed positions during the use and display of the kiosk. As shown in FIGS. 42 and 43, gas cylinder shock absorber 86 connects upper shelf 80 to the rear vertical upright member 24 to cushion movement during storage, as well as its downward rotation deployment; gas cylinder shock absorber 96 connects lower shelf 90 to member 94. Shock absorbers 86, 96 slow, and thereby ease the descent of shelves 80, 90 from their stowed vertical (n.b., while in their respective stowed positions, shelves 80, 90 are vertical when kiosk 10 is in an upright position) positions to their horizontal deployed positions.

Figure 19:
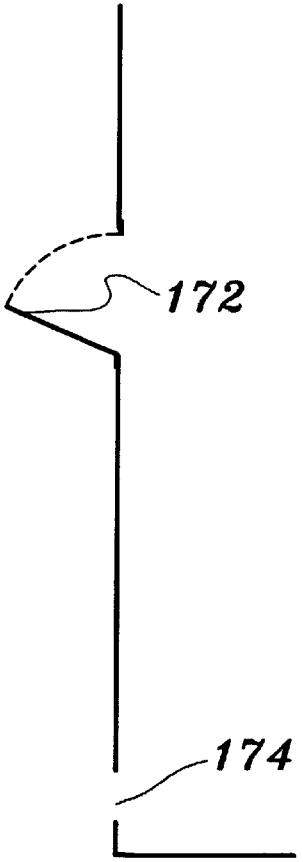
FIG. 19 is a side, cross-sectional view of the back panel and base plate.
Figure 23:
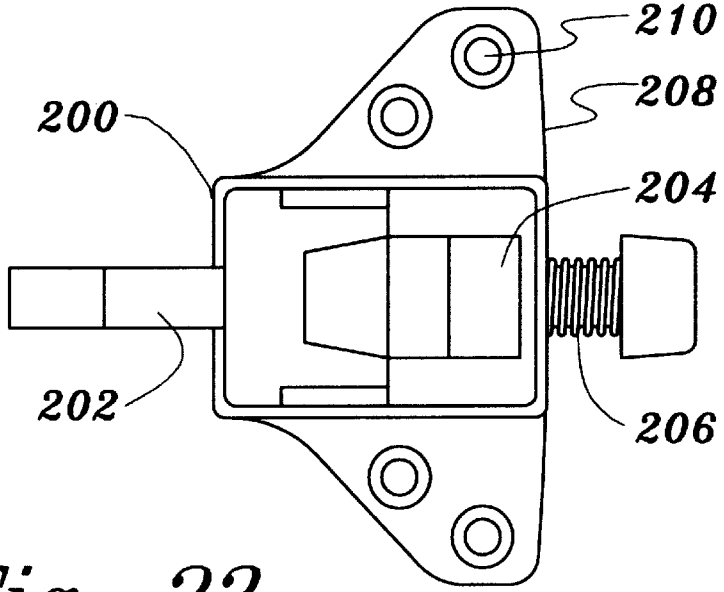
FIG. 23 is a detailed view of a latch used in FIG. 22.

Front frame 70, show in detail in FIGS. 10 through 12, 16 and 17, and panel 170, shown in detail in FIGS. 19 and 20, are configured with screw patterns to be attached to the structural members forming main frame 12. An upper door 132, depending upon its location relative to upper and lower shelves 80, 90, will when opened, enable a visual projector, such as a movie or carousel projector attached to one of shelves 80, 90 to project a series of varying visual images upon to a wall, or movie screen. Preferably, the projector is automatically controlled by a microprocessor based computer secured to the other shelf, ideally in response to interaction between visitors manipulating the touch screen 40 or the keyboard mounted within shelf 30.

Figure 21:
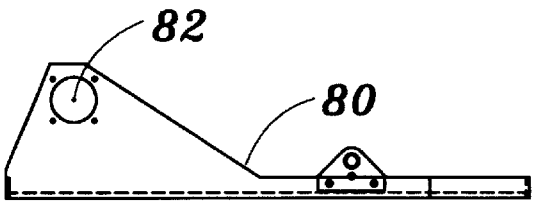
FIG. 21 is a side of view of an upper shelf.
Figure 24:
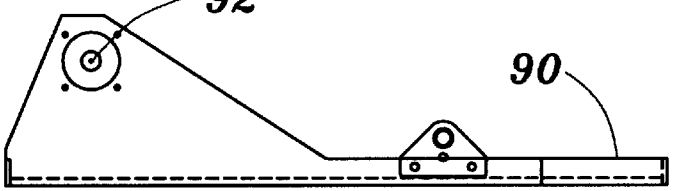
FIG. 24 is a side view of a lower shelf.
Figure 22:
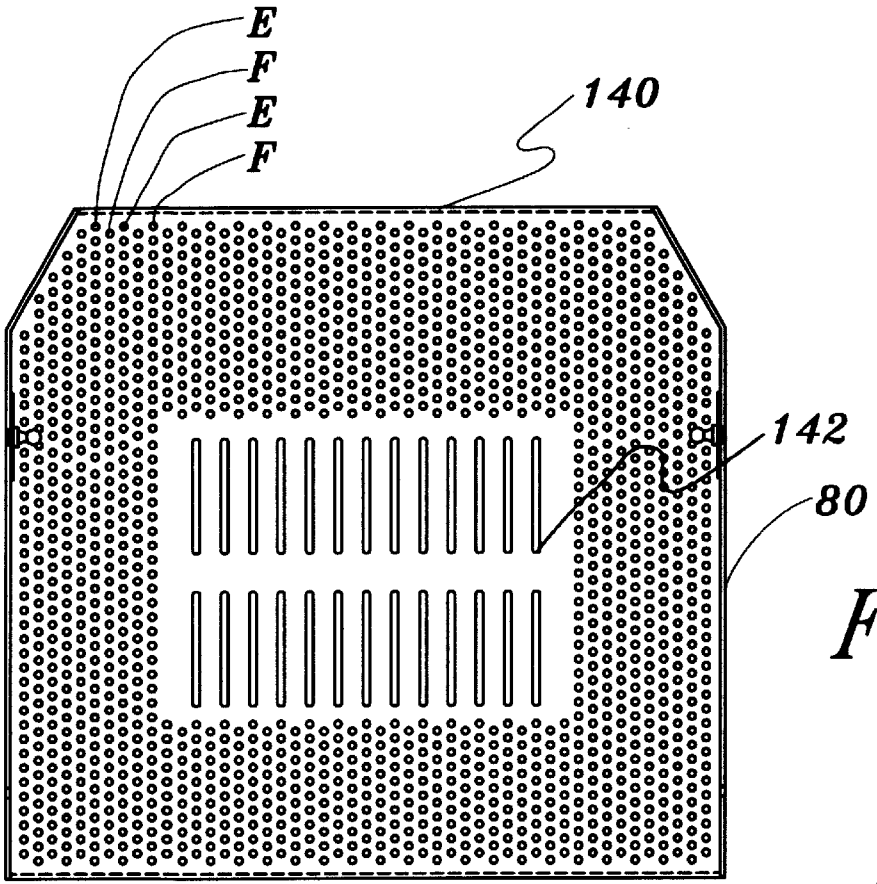
FIG. 22 is a top view of the upper shelf of FIG. 21.
Figure 26:
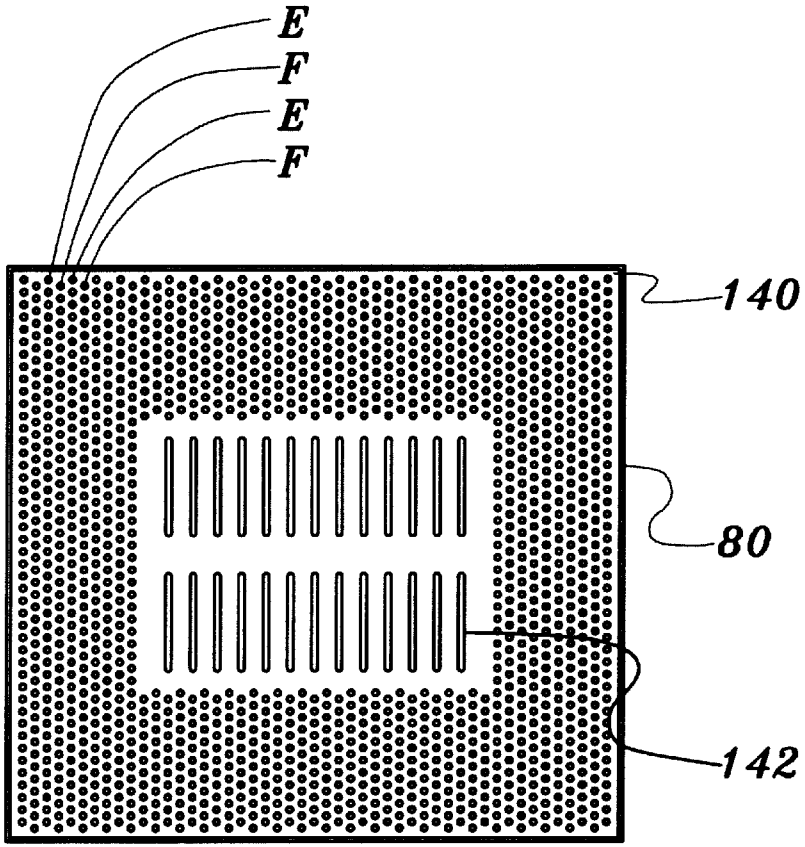
FIG. 26 is a top view of the lower shelf.
Figure 25:
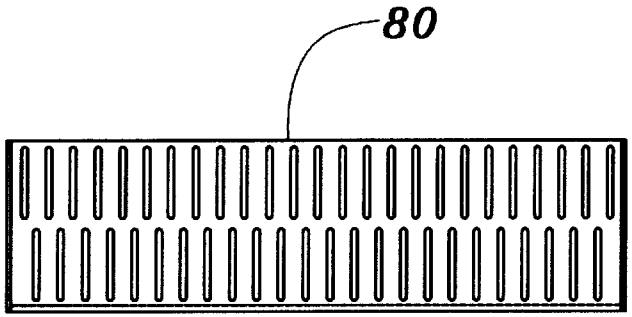
FIG. 25 is a rear view of the lower shelf.
Figure 31:
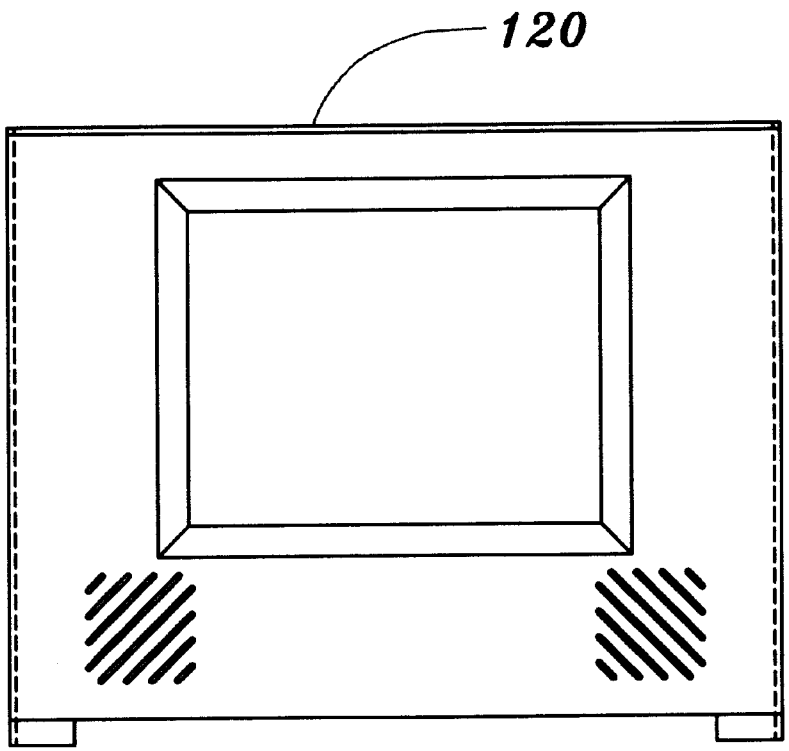
FIG. 31 is a front view of a bezel covering a visual display.
Figure 30:
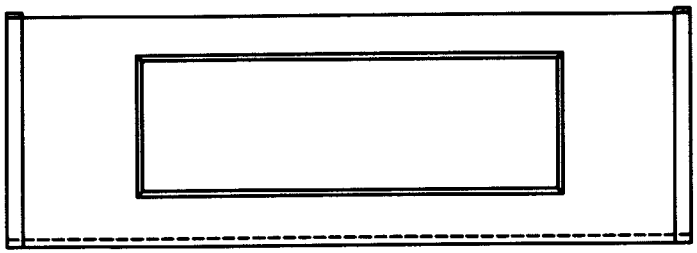
FIG. 30 is a top view of a keyboard shelf.

Both upper shelf 80, shown in detail in FIGS. 21 and 22, and the lower shelf 90, shown in detail in FIGS. 24, 25 and 26, have floor pans that are perforated by a plurality of uniformly spaced apart holes 140 arranged in an ordered array of alternating offset rows E, F of offset holes. In one embodiment, each hole was approximately 0.1875 inches in diameter. Holes 140 along each row were positioned 0.375 inches apart, center-to-center, with a 0.375 inch center-to-center spacing between holes 140 in neighboring E and F rows. In this manner, with a particular embodiment, the center of any hole 140 was equally distantly spaced apart (e.g., by 0.375 inches) from six surrounding neighboring holes 140, regardless of whether the neighboring holes was in the same row or along a diagonal in the next adjacent row. A pattern of vent strips 142 is centrally positioned within the floor 8 pans surrounded by interlaced rows E, F. A plurality of spaced-apart vent strips 142 perforate the floor pans of shelves 80, 90, to enable thermal convection via vent strips 142 to cool electronic equipment mounted on the shelves. Shelves 80, 90 were constructed with 0.125 inch thick flanges.

Figure 39:
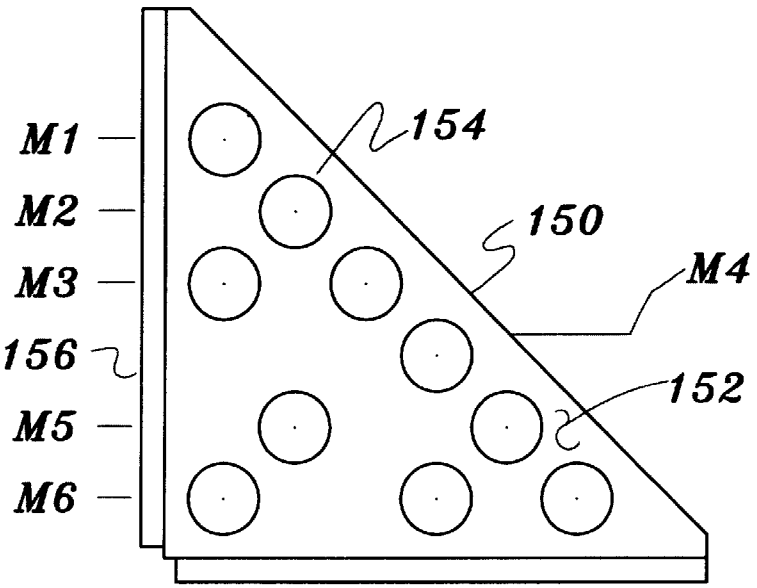
FIG. 39 is a top view of the corner bracket showing in FIG. 38.
Figure 40:
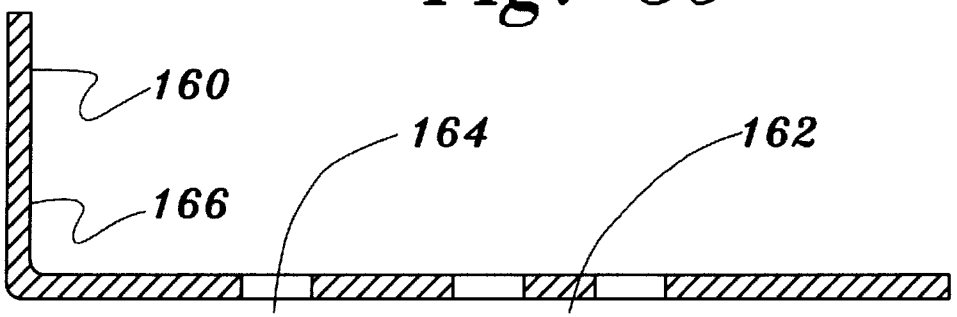
FIG. 40 is a cross-sectional view of another corner bracket.
Figure 37:
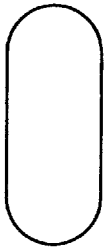
FIGS. 36 and 37 are detailed views showing key holes in the super structure.
Figure 36:
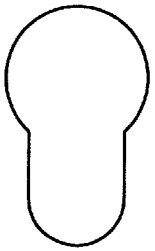
Figure 38:
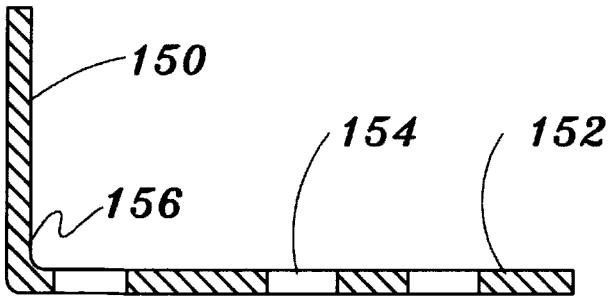
FIG. 38 is a cross-sectional view of a corner bracket.
Figure 41:
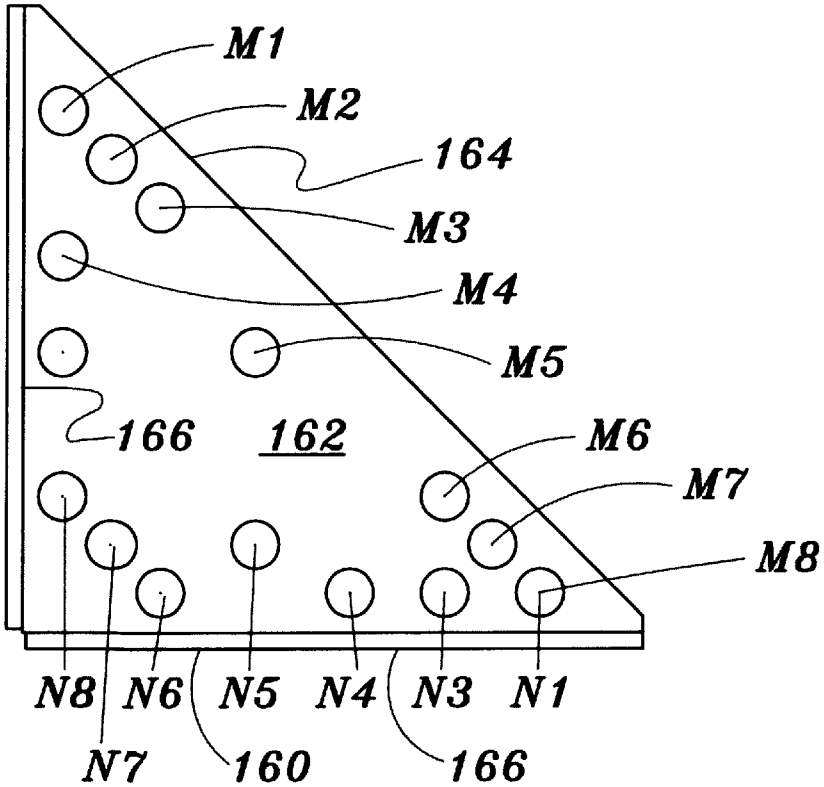
FIG. 41 is a top view of the corner bracket shown in FIG. 40.

Small and large triangularly shaped corner brackets 150, 160, shown respectively in FIGS. 38 and 39, and in FIGS. 40 and 41, have flanges 156, 166 along their two orthogonal sides bordering webs 152, 162 perforated by a cooperating plurality of holes 154, 164 spaced apart so that when placed at each of four corners of the housing of an item of electronic equipment, three bolts will pass through holes 86, 96 in the floor pans as well as holes 154, 164 in all four corner brackets used in over 98.7% of the different sizes of electronic equipment housings. In one embodiment, ten holes 154 each of approximately equal 0.1875 inch diameter, are equidistantly stepped apart by 0.188 inches in six parallel columns M1 through M6, and by 0.188 inches in six parallel rows N1 through N6 arranged orthogonally to the six columns. Columns M1, M2, and M4, and rows N1, N2 and N4 contain only one hole 140 each; while columns M3 and M5, and rows N3 and N5 have two holes 140 each. Column M6 and row N6 each contain three holes 140. The same embodiment may have large corner brackets 160 configured with eight parallel columns M1 through M8 arranged orthogonally to eight parallel rows N1 through N8, with columns M1–M4, M6–M8 and row N1–N3 and N6–N8 equally distantly spaced apart by 0.188 inches each as measured along their respective columns or rows, and with columns M4–M5, and rows N3–N6 each spaced apart by 0.375 inches. Columns M5–M6 are spaced apart by 0.563 inches each. Consequently, four of either the small corner brackets 150, or four of the large corner brackets 160 may each be fastened to a floor pan of shelves 80, 90 by fasteners passing through three holes per corner bracket for any size of rectangular electronic 8 housing to be secured to the floor pan.

Figure 45:
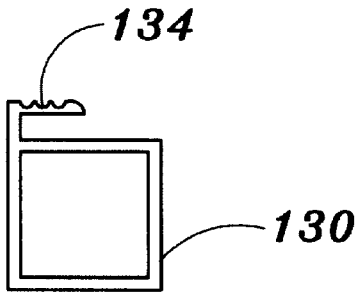
FIGS. 45 and 46 are cross-sectional views showing details of the material used for the super structure.
Figure 46:
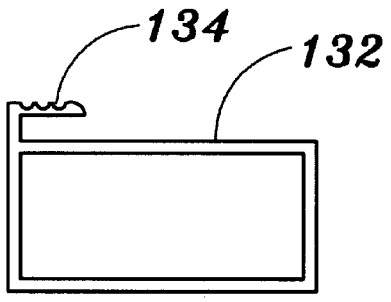

Various vertical structural members of the main and side frames may be constructed of the extruded aluminum shapes 130, 132 shown in FIGS. 45, 46, with exterior kerfs 134 oppositely oriented inwardly in pairs to hold a removable panel to sheath the several exposed sides of kiosk 10 during an exhibition. The right and left side frames, 100, 110, the left side 14 and the right side 16 of the main frame, and the front panel are each trimmed along their vertical and lower horizontal edges with kerfs; consequently one kiosk may hold five panels. The two pairs of side frames 14, 100 and 16, 110 may either hold individual panels decorated as one continuous scene, or alternatively, configured to each hold one larger decorated panel. These panels may be double sided, and be reversed for different shows or, alternatively, removed and replaced entirely, as desired. Typically, these panels are printed, embossed, painted or otherwise decorated with advertising material. Kerfs 134 enable these panels to be quickly, manually either removed, reversed and re-installed, or alternatively, removed and replaced with other panels.

Figure 47:
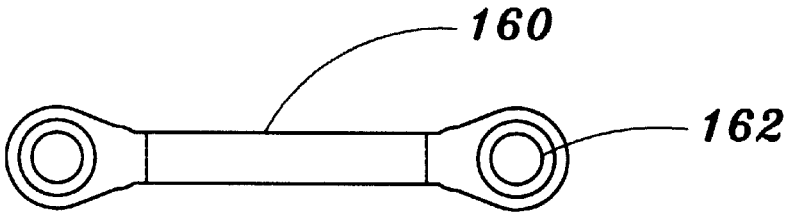
FIG. 47 is a top view of a footman's loop.
Figure 48:
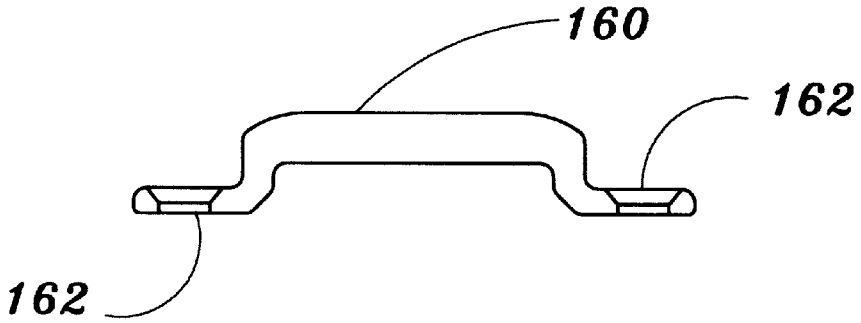
FIG. 48 is a side view of the device showing in FIG. 47.

Pairs of footman loops 160 shown in FIGS. 47, 48, may be attached with, for example, threaded fasteners, to the horizontal floor pans of the perforated upper and lower equipment shelves 80, 90, to accommodate straps that further secure the housing of electronic equipment tightly to those shelves. Latches 200, each having a reciprocating bolt 202 biased by a spring 206, may be bolted to the undersides of shelves 80, 90 via fasteners extending through holes 210 perforating flanges 208, in order to hold shelves 80, 90 in their stowed and in their deployed positions. A thumb button 204 may be manually depressed to release bolt 202 to engage corresponding brackets mounted on structural members 86, 96 during knock-down, or erection of the kiosk.

What is claimed is:

1. A kiosk, comprising: a rectilinear container comprised of:

a rear panel;

first and second spaced-apart side frames each comprised of front and rear structural members, with each rear member attached to a different one of opposite sides of said rear panel, with said first and second side frames extending transversely from said opposite sides of said rear panel;

a first front frame rotatably attached to said front structural member of said first side frame to rotate between a closed position extending from said front structural member of said first side frame toward said front structural member of said second side frame, and an open position extending from and lying coplanarly with said first side frame;

a second front frame rotatably attached to said front structural member of said second side member to rotate between a closed position extending from said front structural member of said second side frame toward said front structural member of said first side frame, and an open position extending from and lying coplanarly with said second side frame;

a first transverse frame transversely joining first extreme portions of said rear panel and said first and second side frames; and a second transverse frame transversely joining second extreme portions of said rear panel and first and second side frames;

a display panel bearing a bezel, said display panel extending between said front structural members and having a major exterior surface terminated by opposite spaced-apart first and second side edges separated by a first cross member pivotally supported to rotate about an axial junction between said front structural members of said first and second side frames and said first transverse frame, with said display panel exhibiting a closed position while said major exterior surface lies alongside said front structural members, and exhibiting an opened position while said first and second side edges are supported by respective ones of said first front frame and said second front frame while said first front frame and said second front frame are in respective said open positions;

a visual display mounted within said bezel to present varying visual images while said display panel is in said opened position; and said first and said second front frames lying across said major exterior surface while said display panel, said first front frame and said second front frame are in respective said closed positions.

2. The kiosk of claim 1, further comprising:

an upper shelf having opposite side edges pivotally supported by corresponding ones of said first and second side frames to travel between a stored position between said first and second front frames while spaced-apart from said rear panel and from said display panel with said display panel separating said upper shelf from said first and said second front frames while said first and said second front frames are in respective said closed positions, and a deployed position with said opposite side edges lying alongside corresponding ones of said first side frame and said first front frame, and said second side frame and said second front frame, while said first front frame and said second front frame are in respective said opened positions; and a lower shelf having opposite side edges pivotally supported by corresponding ones of said first and second side frames to travel between a stored position between said first and second front frames while spaced-apart from said rear panel and from said display panel with said display panel separating said upper shelf from said first and said second front frames while said first and said second front frames are in respective said closed positions, and a deployed position with said opposite side edges lying alongside corresponding ones of said first side frame and said first front frame, and said second side frame and said second front frame, while said first front frame and said second front frame are in respective said opened positions.

3. The kiosk of claim 1, further comprising:

an upper shelf providing an upper areal shelf space having opposite side edges pivotally supported by corresponding ones of said first and second side frames to travel between a stored position between said first and second front frames while spaced-apart from said rear panel and from said display panel with said display panel separating said upper shelf from said first and said second front frames while said first and said second front frames are in respective said closed positions, and a deployed position with said opposite side edges lying alongside corresponding ones of said first side frame and said first front frame, and said second side frame and said second front frame, while said first front frame and said second front frame are in respective said opened positions; and a lower shelf providing a lower areal shelf space having opposite side edges pivotally supported by corresponding ones of said first and second side frames to travel between a stored position spaced-apart from said upper shelf and in between said first and second front frames while spaced-apart from said rear panel and from said display panel with said display panel separating said upper shelf from said first and said second front frames while said first and said second front frames are in respective said closed positions, and a deployed position spaced-apart from said upper shelf with said opposite side edges lying alongside corresponding ones of said first side frame and said first front frame, and said second side frame and said second front frame, while said first front frame and said second front frame are in respective said opened positions;

said upper shelf space and said lower shelf space being approximately equal in area.

4. The kiosk of claim 1, further comprising:

an upper shelf exhibiting a first length, said upper shelf having a first width orthogonal to said first length terminated by opposite side edges pivotally supported by corresponding ones of said first and second side frames to travel between a stored position between said first and second front frames while spaced-apart from said rear panel and from said display panel with said display panel separating said upper shelf from said first and said second front frames while said first and said second front frames are in respective said closed positions, and a deployed position with said opposite side edges lying alongside corresponding ones of said first side frame and said first front frame, and said second side frame and said second front frame, while said first front frame and said second front frame are in respective said opened positions; and a lower shelf exhibiting a second length, said lower shelf having a second width orthogonal to said second length terminated by opposite side edges pivotally supported by corresponding ones of said first and second side frames to travel between a stored position between said first and second front frames while spaced-apart from said rear panel and from said display panel with said display panel separating said upper shelf from said first and said second front frames while said first and said second front frames are in respective said closed positions, and a deployed position with said opposite side edges lying alongside corresponding ones of said first side frame and said first front frame, and said second side frame and said second front frame, while said first front frame and said second front frame are in respective said opened positions;

said first length being substantially equal to said second length, and said first width being substantially equal to said second width.

5. The kiosk of claim 1, further comprising:

an upper shelf providing an upper shelf area having opposite side edges pivotally supported by corresponding ones of said first and second side frames to travel between a stored position between said first and second front frames while spaced-apart from said rear panel and from said display panel with said display panel separating said upper shelf from said first and said second front frames while said first and said second front frames are in respective said closed positions, and a deployed position with said opposite side edges lying alongside corresponding ones of said first side frame and said first front frame, and said second side frame and said second front frame, while said first front frame and said second front frame are in respective said opened positions; and a lower shelf providing a lower shelf area having opposite side edges pivotally supported by corresponding ones of said first and second side frames to travel between a stored position between said first and second front frames while spaced-apart from said rear panel and from said display panel with said display panel separating said upper shelf from said first and said second front frames while said first and said second front frames are in respective said closed positions, and a deployed position with said opposite side edges lying alongside corresponding ones of said first side frame and said first front frame, and said second side frame and said second front frame, while said first front frame and said second front frame are in respective said opened positions.

6. A kiosk, comprising:

a container comprised of:

a rear panel;

first and second spaced-apart side frames each comprised of front and rear structural members, with each rear member attached to a different one of opposite sides of said rear panel, with said first and second side frames extending transversely from opposite sides of said rear panel;

a first front frame attached to said front structural member of said first side frame to exhibit a closed position extending from said front structural member of said first side frame toward said front structural member of said second side frame, and an open and spatially different position lying coplanarly with said first side frame;

a second front frame rotatably attached to said front structural member of said second side member to exhibit a closed position extending from said front structural member of said second side frame toward said front structural member of said first side frame, and an open position lying coplanarly with said second side frame;

a first transverse frame transversely joining said rear panel and said first and second side frames; and a second transverse frame, transversely joining said rear panel and first and second side frames;

a visual display mounted between said front structural members and having a major exterior surface terminated by opposite spaced-apart first and second side edges separated by a first cross member supported at a junction between said front structural members of said first and second side frames and said first transverse frame, with said visual display exhibiting a closed position while said major exterior surface lies alongside said front structural members, and exhibiting an opened position to present varying visual images while said display panel is in said opened position, and while said first and second side edges are supported by respective ones of said first front frame and said second front frame while said first front frame and said second front frame are in respective said open positions; and said first and said second front frames lying across said major exterior surface while said visual display, said first front frame and said second front frame are in respective said closed positions.

7. The kiosk of claim 1, further comprising a plurality of shelves each providing a separate and distinct shelf area pivotally supported by corresponding ones of said first and second side frames to travel between:

a stored position between said first and second front frames while spaced-apart from said rear panel and from said display panel with said display panel separating said shelves from said first and said second front frames while said first and said second front frames are in respective said closed positions, and a deployed position with each of said shelves lying transversely between said rear panel, said first side frame and said first front frame, and said second side frame and said second front frame, while said first front frame and said second front frame are in respective said opened positions.

8. The kiosk of claim 7, with said shelf area of one of said plurality of shelves bearing a plurality of perforations spaced-apart in an array of a plurality of parallel diagonal lines and a plurality of parallel, alternating offset columns.

9. The kiosk of claim 8, with a corner bracket retentively situate upon one of said major surfaces, said corner bracket comprising a minor surface area terminated by an edge extending transversely to said minor surface, and a plurality of spaced-apart discrete apertures in said minor surface area, each of said apertures having a center aligned along a plurality of intersecting diametric lines with a plurality of others of said apertures.

10. The kiosk of claim 8, with a corner bracket retentively situate upon one of said major surfaces, said corner bracket comprising a minor surface area terminated by an edge extending transversely to said minor surface, and a plurality of spaced-apart discrete apertures in said minor surface area, each of said apertures having a center aligned with a plurality of others of said plurality of apertures along either one of a pair of perpendicularly intersecting diametric lines or a pair of obliquely intersecting lines.

11. The kiosk of claim 8, with a corner bracket retentively situate upon one of said major surfaces, said corner bracket comprising a minor surface area terminated by an edge extending transversely to said minor surface, and a plurality of spaced-apart discrete apertures in said minor surface area, each of said apertures having a center aligned with a plurality of others of said plurality of apertures along either a pair of obliquely intersecting said diametric lines or one of a pair of said diametric lines formed from one of a first plurality of equally spaced-apart said diametric lines and one of a second plurality of equally spaced-apart said diametric lines lying perpendicular to said first plurality.

12. The kiosk of claim 1, further comprising a plurality of shelves each providing a separate and distinct shelf area providing a cargo-bearing major surface, with each of said shelves being pivotally supported by corresponding ones of said first and second side frames to travel between:

a stored position between said first and second front frames while spaced-apart from said rear panel and from said display panel with said display panel separating said shelves from said first and said second front frames while said first and said second front frames are in respective said closed positions and each said cargo-bearing major surface faces said rear panel, and a deployed position with each of said shelves positioning a cargo-bearing major surface to lie transversely between said rear panel, said first side frame and said first front frame, and said second side frame and said second front frame, while said first front frame and said second front frame are in respective said opened positions.

13. The kiosk of claim 1, with said visual display comprising a thin-film capacitive touch screen, and said bezel covering a periphery of said touch screen.

14. The kiosk of claim 1, further comprised of one of said first and second side frames being constructed with said front structural member being spaced-apart from said rear structural member.

15. The kiosk of claim 6, with said visual display comprising a thin-film capacitive touch screen positioned within said major exterior surface.

16. The kiosk of claim 6, further comprised of one of said first and second side frames being constructed with said front structural member being spaced-apart from said rear structural member.

17. A kiosk, comprising:

a shipping container comprised of:

a rear panel; first and second spaced-apart rear sides being attached to a different one of opposite sides of said rear panel, and with said first and second sides extending transversely from opposite sides of said rear panel;

a trapezoid shaped first front side having a longer proximal edge rotatably attached to said first rear side to rotate between a closed position extending from said first rear side toward said second rear side, and an open position with a shorter distal edge of said first front side spaced apart from said first and second rear sides and with said first front side extending from and aligned with said first rear side and;

a trapezoid shaped second front side having a longer proximal edge rotatably attached to said second rear side to rotate between a closed position extending from said second rear side toward said first rear side, and an open position with a shorter distal edge of said second front side spaced apart from said first front side and spaced apart from said first and second rear sides and with said second front side extending from and aligned with said second rear side; and a transverse frame transversely joining said first and second rear sides; and a display panel extending between said first and second rear sides and having a major exterior surface terminated by opposite spaced-apart first and second side edges separated by a first cross member pivotally supported to rotate about an axial junction between said first rear side and said first front side and said second rear side and said second front side, with said display panel exhibiting a closed position while said major exterior surface lies alongside said front side members, and exhibiting an opened position while said first and second side edges are supported by respective ones of said first front side and said second front side when said first front side and said second front side are in corresponding said open positions;

said first front side and said second front side lying across said major exterior surface while said major exterior surface, said first front side and said second front side are in respective said closed positions; and a visual display mounted within said display panel to present varying visual images while said display panel is in said opened position.

18. The kiosk of claim 17, further comprising a plurality of shelves each providing a separate and distinct shelf area providing a cargo-bearing major surface, with each of said shelves being pivotally supported by corresponding ones of said first and second rear sides to travel between:

a stored position between said first and second front sides while spaced-apart from said rear panel and from said display panel with said display panel separating said shelves from said first and said second front sides while said first and said second front sides are in respective said closed positions and each said cargo-bearing major surface faces said rear panel, and a deployed position with each of said shelves positioning a cargo-bearing major surface to lie transversely between said rear panel, said first rear side and said first front side, and said second rear side and said second front side, while said first front side and said second front side are in corresponding said opened positions.

19. The kiosk of claim 17, further comprising a plurality of shelves each providing a separate and distinct shelf area providing a cargo-bearing major surface, with each of said shelves being pivotally supported by corresponding ones of said first and second side frames to travel between:

a stored position between said first and second front frames while spaced-apart from said rear panel and from said display panel with said display panel separating said shelves from said first and said second front frames while said first and said second front frames are in respective said closed positions and each said cargo-bearing major surface faces said rear panel, and a deployed position with each of said shelves positioning a cargo-bearing major surface to lie transversely between said rear panel, said first side frame and said first front frame, and said second side frame and said second front frame, while said first front frame and said second front frame are in respective said opened positions.

20. The kiosk of claim 19, with said visual display comprising a thin-film capacitive touch screen continuously borne by said display panel while said display panel is in said opened position and in said closed position.

21. The kiosk of claim 18, further comprised of:

said shelf area of one of said plurality of shelves bearing a plurality of perforations spaced-apart in an array of a plurality of parallel diagonal lines and a plurality of parallel, alternating offset columns; and a corner bracket retentively situate upon one of said major surfaces, said corner bracket comprising a minor surface area terminated by an edge extending transversely to said minor surface, and a plurality of spaced-apart discrete apertures in said minor surface area, each of said apertures having a center aligned with a plurality of others of said plurality of apertures along either one of a pair of perpendicularly intersecting diametric lines or a pair of obliquely intersecting lines.

22. The kiosk of claim 21, with said visual display comprising a thin-film capacitive touch screen, and said bezel covering a periphery of said touch screen.

23. A kiosk, comprising:

a rear side comprised of:

first and second spaced-apart side frames each comprised of discrete and spaced-apart front and rear structural members, with each rear structural member positioned on a different and opposite side of said rear side, with said first and second side frames extending transversely from opposite sides of said rear side;

a first front frame rotatably attached to said front structural member of said first side a frame to rotate between a closed position extending from said front structural member of said first side frame toward said front structural member of said second side frame, and an open position extending from and aligned with said first side frame;

a second front frame rotatably attached to said front structural member of said second side member to rotate between a closed position extending from said front structural member of said second side frame toward said front structural member of said first side frame, and an open position extending from and aligned with said second side frame;

a first transverse frame transversely joining first extreme portions of said rear panel and said first and second side frames; and a second transverse frame transversely joining second extreme portions of said rear panel and first and second side frames;

a display panel bearing a visual display mounted to present varying visual images while said display panel is in an opened position, said display panel extending between said front structural members and having a major exterior surface terminated by opposite spaced-apart first and second side edges separated by a first cross member pivotally supported to rotate about an axial junction between said front structural members of said first and second side frames and said first transverse frame, with said display panel exhibiting a closed position while said major exterior surface lies alongside said front structural members and exhibiting an opened position while said first and second side edges are supported by respective ones of said first front frame and said second front frame while said first front frame and said second front frame are in corresponding said open positions;

said first and said second front frames lying across said major exterior surface while said major exterior surface, said first front frame and said second front fame are in corresponding said closed positions; and a plurality of shelves each providing a separate and distinct shelf area providing a cargo-bearing major surface, with each of said shelves being pivotally supported by corresponding ones of said first and second side frames to travel between;

a deployed position with each of said shelves positioning each said cargo-bearing major surface to lie transversely between said rear structural members, said first side frame and said first front frame, and said second side frame and said second front frame, while said first front frame and said second front frame are in corresponding said opened positions with each said cargo-beating major surface oriented to receive and support items of cargo, and a stored position between said first and second frames while spaced-apart from said rear panel and from said display panel with said display panel separating said shelves from said first and said second front frames while said first and said second front frames are in respective said closed positions and each said cargo-bearing major surface facing said rear structural members and continuing to support all of the items of cargo placed thereon while in said deployed position.

24. The kiosk of claim 22, with said visual display comprising a thin-film capacitive touch screen continuously borne by said display panel while said display panel is in said opened position and in said closed position.

25. The kiosk of claim 22, further comprised of:

said shelf area of one of said plurality of shelves bearing a plurality of perforations spaced-apart in an array of a plurality of parallel diagonal lines and a plurality of parallel, alternating offset columns; and a corner bracket retentively situate upon one of said major surfaces, said corner bracket comprising a minor surface area terminated by an edge extending transversely to said minor surface, and a plurality of spaced-apart discrete apertures in said minor surface area, each of said apertures having a center aligned with a plurality of others of said plurality of apertures along either:

a pair of obliquely intersecting said diametric lines, or one of a pair of said diametric lines formed from one of a first plurality of equally spaced-apart said diametric lines and one of a second plurality of equally spaced-apart said diametric lines lying perpendicularly to said first plurality.

26. The Kiosk of claim 1, with said visual display comprising a thin-film capacitive touch screen continuously borne by said display panel while said display panel is in said opened position and in said closed position.

* * * * *